US009284091B2

(12) United States Patent
Shalkop

(10) Patent No.: US 9,284,091 B2
(45) Date of Patent: Mar. 15, 2016

(54) DAY OF OPENING REMINDER FOR A CONTAINER

(71) Applicant: David Lawrence Shalkop, Jupiter, FL (US)

(72) Inventor: David Lawrence Shalkop, Jupiter, FL (US)

( * ) Notice: Subject to any disclaimer, the term of this patent is extended or adjusted under 35 U.S.C. 154(b) by 0 days.

(21) Appl. No.: 14/211,409

(22) Filed: Mar. 14, 2014

(65) Prior Publication Data

US 2014/0262900 A1 Sep. 18, 2014

Related U.S. Application Data

(60) Provisional application No. 61/783,496, filed on Mar. 14, 2013.

(51) Int. Cl.

| | |
|---|---|
| ***B65D 51/24*** | (2006.01) |
| ***B65D 5/72*** | (2006.01) |
| ***B65D 5/74*** | (2006.01) |
| ***B65D 5/42*** | (2006.01) |

(52) U.S. Cl.

CPC ..... *B65D 5/727* (2013.01); *B65D 5/4212* (2013.01); *B65D 5/746* (2013.01)

(58) Field of Classification Search

CPC ..... B65D 51/245; B65D 5/068; B65D 5/727; B65D 5/4212; B65D 5/746; A61J 7/04; G09F 3/00; G09F 2003/0208

USPC ..... 206/459.1, 459.5, 831, 534; 229/116.1, 229/118, 87.08; 116/308; 40/637

See application file for complete search history.

(56) References Cited

U.S. PATENT DOCUMENTS

| | | | | |
|---|---|---|---|---|
| 2,024,889 | A | | 12/1935 | Simeone |
| 2,201,524 | A | | 5/1940 | Esty |
| 2,470,199 | A | * | 5/1949 | Stewart ..... 229/213 |
| 2,750,095 | A | * | 6/1956 | Alden ..... 229/214 |
| 3,116,002 | A | | 12/1963 | Crawford et al. |
| 3,120,333 | A | | 2/1964 | Seiple |
| 3,120,335 | A | | 2/1964 | Egleston et al. |
| 3,185,375 | A | | 5/1965 | Thomas |
| 3,205,603 | A | * | 9/1965 | Brumley ..... 206/459.1 |
| 3,232,516 | A | | 2/1966 | Arslanian |
| 3,339,820 | A | * | 9/1967 | Krzyzanowski ..... 229/216 |
| 3,349,988 | A | | 10/1967 | Horning |
| 3,498,815 | A | * | 3/1970 | Moors et al. ..... 427/145 |
| 3,770,185 | A | * | 11/1973 | Reeves ..... 229/213 |
| 3,818,858 | A | | 6/1974 | Kramer et al. |
| 3,825,168 | A | | 7/1974 | MacEwen |
| 4,093,115 | A | * | 6/1978 | Bachner et al. ..... 229/216 |

(Continued)

FOREIGN PATENT DOCUMENTS

WO 91/13005 9/1991

*Primary Examiner* — Steven A. Reynolds

(74) *Attorney, Agent, or Firm* — Fleit Gibbons Gutman Bongini & Bianco PL; Jon A. Gibbons

(57) ABSTRACT

A container (100 and 600) has a sealed top formed from adhered sealing panels at a top of the container that keeps contents of the container sealed until ready for use. A top of the container is provided with a day of opening reminder (131 and 631). The day of opening reminder includes tabs (163, 563 and 663) made of a same material as the container. Each tab includes a different symbol that corresponds to a name of a day of the week. The day of opening reminder includes perforations (134 and 634) or cuts between each tab thereby allowing one of the tabs to be moved into a different position relative to the other tabs, thereby conveying information about the day of week that the container was first opened.

20 Claims, 10 Drawing Sheets

(56) References Cited

U.S. PATENT DOCUMENTS

| | | | | | |
|---|---|---|---|---|---|
| 4,194,674 | A | | 3/1980 | Pearson | |
| 4,356,951 | A | | 11/1982 | Sharp | |
| 4,621,670 | A | | 11/1986 | Yuen | |
| 4,630,733 | A | * | 12/1986 | Fear | 206/459.1 |
| 4,691,858 | A | | 9/1987 | Peer, Jr. | |
| 4,805,775 | A | * | 2/1989 | Fear | 206/459.1 |
| 4,834,241 | A | | 5/1989 | Southern | |
| 4,901,457 | A | * | 2/1990 | Chandler | 40/306 |
| 4,915,236 | A | | 4/1990 | Kamin et al. | |
| 5,492,077 | A | | 2/1996 | Rose | |
| 5,501,394 | A | * | 3/1996 | Eno | 229/137 |
| 5,516,037 | A | | 5/1996 | Okamoto et al. | |
| 5,601,233 | A | * | 2/1997 | Kageyama et al. | 229/216 |
| 5,662,265 | A | * | 9/1997 | Jensen | 229/107 |
| 5,881,597 | A | | 3/1999 | Brooks | |
| 6,089,180 | A | * | 7/2000 | Nichols, Jr. | 116/309 |
| D439,744 | S | * | 4/2001 | Ho | D3/323 |
| 6,244,456 | B1 | * | 6/2001 | Hanlon | 220/269 |
| 6,868,627 | B2 | | 3/2005 | Elias | |
| 6,938,768 | B2 | | 9/2005 | Ferretti et al. | |
| 7,617,622 | B2 | | 11/2009 | Elias | |
| 7,987,621 | B2 | | 8/2011 | Elias | |
| 8,020,507 | B2 | | 9/2011 | Strong | |
| 8,302,846 | B2 | | 11/2012 | Koeda et al. | |
| 2004/0060840 | A1 | | 4/2004 | Williams et al. | |
| 2005/0236293 | A1 | * | 10/2005 | Turvey et al. | 206/459.1 |
| 2008/0110785 | A1 | * | 5/2008 | Rocco | 206/459.5 |
| 2010/0044267 | A1 | * | 2/2010 | Tolibas-Spurlock et al. | 206/524.7 |
| 2010/0108555 | A1 | | 5/2010 | Genosar | |
| 2010/0326864 | A1 | * | 12/2010 | Campbell | 206/459.5 |

* cited by examiner

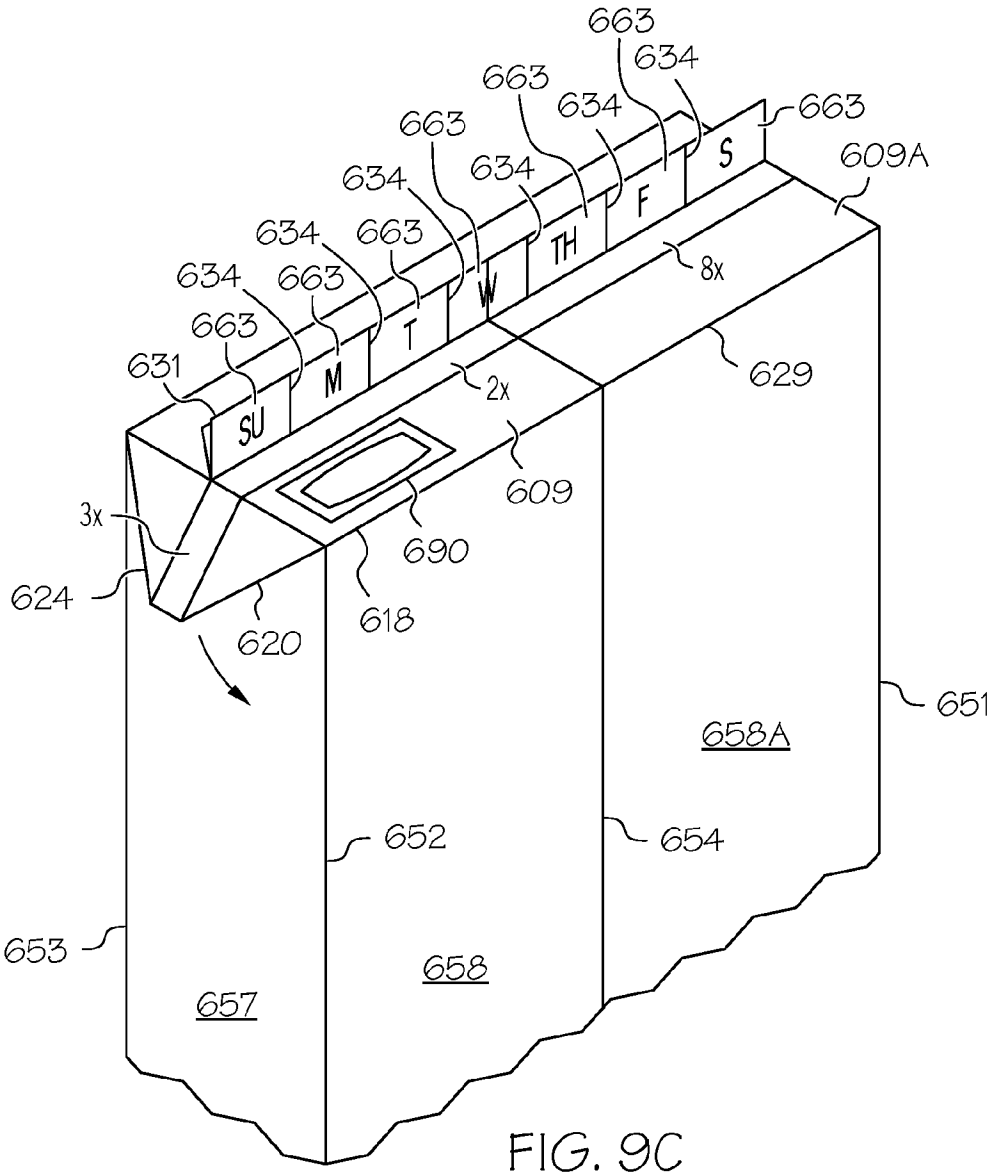
651
609A
663
629
658A
654
634
663
634
663
634
663

DAY OF OPENING REMINDER FOR A CONTAINER

CROSS-REFERENCE TO RELATED APPLICATION

This application is based upon and claims priority to U.S. Provisional Patent Application Ser. No. 61/783,496, entitled "DAY OF OPENING REMINDER FOR A CONTAINER" and filed Mar. 14, 2013, the entire disclosure of which is hereby incorporated by reference herein.

BACKGROUND

1. Field

This invention relates generally to containers, and more specifically to paperboard-style containers.

2. Related Art

Paperboard-style containers are designed to hold any one of many diverse substances including liquid products, such as dairy and dairy-substitute products. Containers of dairy and dairy-substitute products, such as soy, almond and rice milk, have a "use-by" date imprinted on the container. Containers of other types of perishable liquids and food products may also have a "use-by" date imprinted on the container. Typically, the "use-by" date is a date that is several weeks or months subsequent to a date on which the container was filled with a perishable liquid or food product by a supplier of the product. Oftentimes, the container also specifies that the product should be used within a certain number of days subsequent to the date on which the container was first opened.

A paperboard-style container is formed from a blank which is a single, flat piece of paperboard-like material that is shaped and sized such that it can form a paperboard-style container. The blank usually has several fold lines. The paperboard-style container is formed by folding the blank along the several fold lines. Some type of adhesive maintains the blank in a shape of a container, after folding. The paperboard-style container usually has a shape of a tubular body having a square or rectangular cross-section and four large flat sides, a flat bottom and a gable top or a flat top.

BRIEF DESCRIPTION OF THE DRAWINGS

The present invention is illustrated by way of example and is not limited by the accompanying figures, in which like references indicate similar elements. Elements in the figures are illustrated for simplicity and clarity and have not necessarily been drawn to scale.

FIGS. 9A, 9B and 9C are perspective views of the top portion of the flat-top paperboard-style container of FIG. 6, at three successive stages of manufacture.

DETAILED DESCRIPTION

Figure 1:
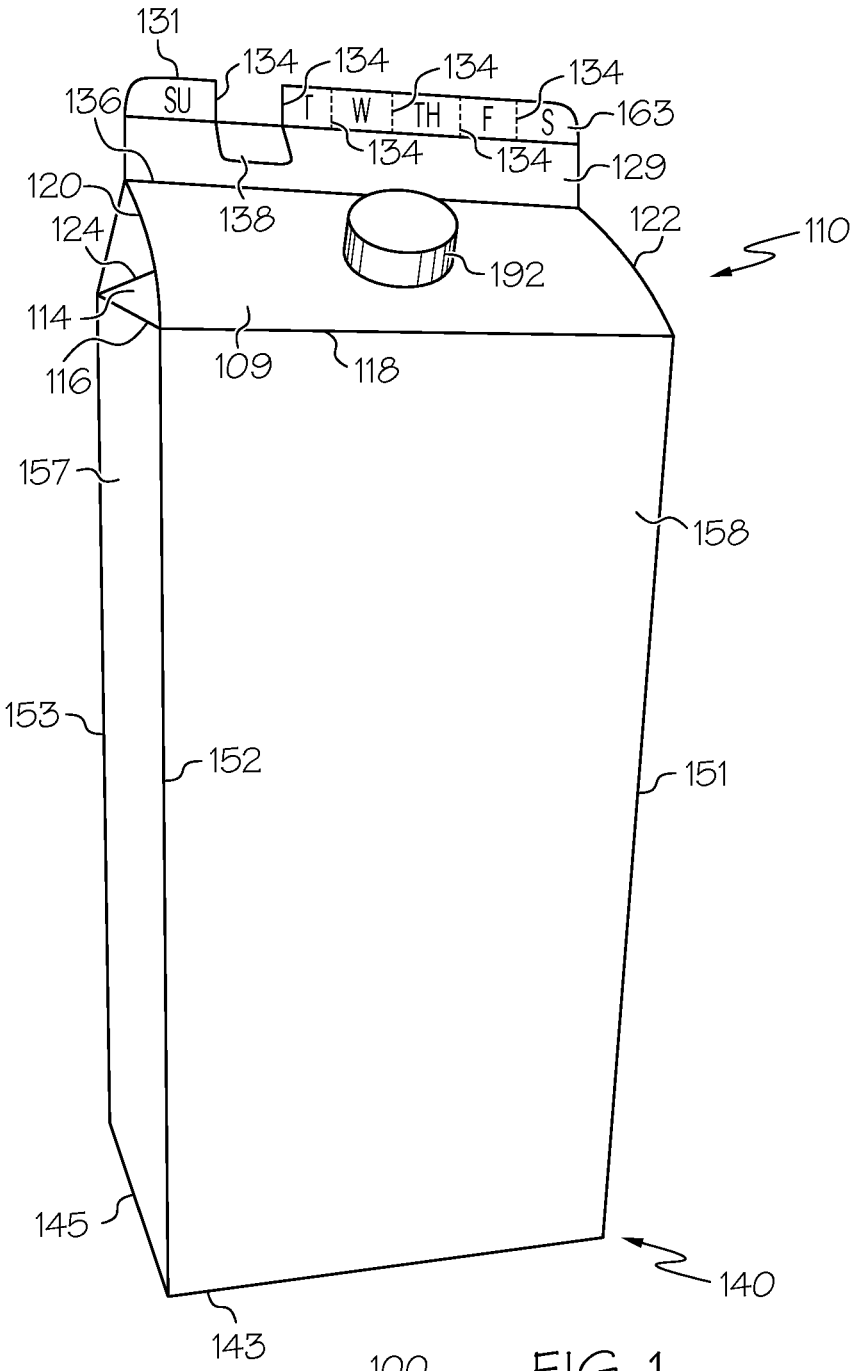
FIG. 1 is a perspective view of one embodiment of a gable-top paperboard-style container in accordance with the invention.

Typically, a paperboard-style container (hereinafter "container") that holds a dairy or dairy-substitute product, other perishable food or any perishable liquid (hereinafter "product" or "contents of the container") specifies that the product should be used within certain predetermined period subsequent to a date on which the container is first opened. A problem is that once the container is opened, there is nothing on the container to inform a user of the day that the container was first opened; therefore, a user does not know when the certain predetermined period has expired. A user should not rely on a use-by date imprinted on the container because the use-by date could be, and usually is, a date farther in the future than an end date of the certain predetermined period. A typical certain predetermined period is five (5) to ten (10) days.

A container in accordance with the invention comprises a day of opening reminder. The day of opening reminder comprises a plural number of tabs. In one embodiment, the number of tabs is seven (7), each tab representing one of the seven days of a week. The tabs are at a top of the container. In one embodiment, the container has a gable top (see FIGS. 1-5), and the tabs are at a top edge of the gable. In another embodiment, the container has a flat top (see FIGS. 6-10). In one embodiment, the tabs are perforated tabs. The perforated tabs are formed during manufacture of the container. In one embodiment, the perforated tabs are formed when the container is still in the form of a blank. In such embodiment, the tab material is an integral part of the blank material, and lines of perforations are made in the blank to form and define the perforated tabs. Typically, the perforations are made in the blank at about the same time that fold lines are made in the blank. The term "perforations" means partial cuts made in the paperboard-like material between the tabs, thereby defining each tab, and allowing a tab to be at least partially separated from the container using reasonable manual force, but otherwise allowing all the tabs to remain completely connected to the container absent application of the reasonable manual force. In another embodiment, a cut is made between each tab during the manufacture of the container.

Each of the seven perforated tabs includes an indication of a different day of the week. In one embodiment, each tab includes a name of a different day of a week or an abbreviation for the name of a different day of a week. In one embodiment, each of the seven perforated tabs has one of the following letters on it: SU, M, T, W, TH, F and S, which represent Sunday, Monday, Tuesday, Wednesday, Thursday, Friday and Saturday, respectively. The letters are printed or embossed, or both printed and embossed on the tabs. In another embodiment (not shown), each tab includes a numeral that corresponds to a week as a whole, i.e., week one to week seven. In another embodiment, there are eight (8) perforated tabs with one of the following markings on each perforated tab: SU, M, T, W, TH, F, S and 1 WK, which represent Sunday, Monday, Tuesday, Wednesday, Thursday, Friday, Saturday and one week, respectively. For products that last longer than seven (7) days, the one week tab could be bent using reasonable manual force to show that seven (7) days have passed since the container was opened.

Some containers have the use-by date printed on one side of the gable of the container. In such instances, the letters representing the days of the week, in accordance with the invention, are printed on the opposite side of the gable of the container. However, in some other embodiments, the letters representing the days of the week can be printed on the same side as the use-by date. Furthermore, in still other embodiments, the letters representing the days of the weeks can be printed on the same side as the use-by date and on the side opposite the side that has the use-by date.

When the container in accordance with the invention is opened for the first time, a user folds a tab representing a day of the week on which the container was opened. In the embodiment that has a line of perforations between adjacent tabs, a user folds such tab by manually breaking the perforations on each side of such tab. In the other embodiment that has a cut line between adjacent tabs, a user simply folds such tab. A user who initially opened the container can then be reminded of the day that the user initially opened the container by looking at the state, or condition, of the tabs. A user who did not initially open the container can learn the day that the container was first opened by another user by looking at the state, or condition, of the tabs. In other words, the state, or condition, of the tabs provides evidence of the day that the container was first opened. At all subsequent times, the user, including any user, will then know which day within the certain predetermined period of days that the container was first opened. For example, if the product is to be consumed within seven (7) days, then eight (8) days after the container was first opened, a user will know to dispose of the container and its contents, and possibly purchase more of the product. For example, if a user sees that the tab representing Wednesday is folded down, and the product is to be consumed within seven (7) days from opening, then the user will know to stop using the product in the container after Wednesday of the following week.

FIG. 1 is a perspective view of one embodiment of a gable-top paperboard-style container 100 (hereinafter "container 100") in accordance with the invention. The container 100 includes a body that has a general shape of a parallelepiped. In one embodiment, the body has a general shape of a rectangular cuboid. FIG. 1 shows the container 100 with a substantially gable top 110, a substantially flat bottom 140, and four flat sides (only two of these four flat sides, main body panels 157 and 158, appear in FIG. 1). The container 100 is a type of container that is widely used for packaging of edible liquids such as milk, dairy, dairy-substitutes, fruit juices, broths, eggs, etc., that have a use-by date. The container 100 can also be used for packaging non-edible liquids and granular or pourable materials that have a use-by date. The container 100 is formed from a paperboard blank 200 (see FIG. 2). The container 100 has a sealed gable top at a top of the container that keeps the container sealed until the contents of the container are ready for use. The sealed gable top is created by sealing panels 102, 103, 105, 106, 129 (see FIG. 2) and 132, which also form a ridge at an apex of the gable top. The ridge at the apex of the gable top is provided with a day of opening reminder 131 in accordance with the invention. The day of opening reminder 131 includes a set of seven tabs 163 made of a same material as the container.

The day of opening reminder 131 includes lines of perforations 134 between each tab. The lines of perforations 134, when selectively broken, allow any one of the seven tabs 163 to be moved into a different position relative to the other tabs, thereby conveying information about the day of week that the container 100 was first opened. Tab 138 is one tab among the plurality of tabs 163 which has been assigned a specific reference number for discussion purposes herein. Tab 138 is the second tab from the left in FIG. 1. Comparing FIG. 1 and FIG. 4A, it can be seen that the second tab from the left has an "M" on it. As shown in FIG. 1, tab 138 has been separated along the lines of perforations 134 between tab 138 and the tabs 163 on each side of tab 138. In FIG. 1, the second tab from the left, i.e., tab 138, is shown in a bent down position from its original position. Advantageously, a user is able to manually bend down tab 138 without bending down any of the other tabs, and, in particular, without bending down the adjacent tabs. As shown in FIG. 1, the tab 163 with "SU" on it and the tab 163 with "T" on it remain in their original upright positions. Advantageously, repositioning one tab relative to the other tabs does not affect the seal of the container 100. The sealing panels prevent the contents of the container 100 from coming out of the container through the apex in spite of a tab, such as tab 138, being bent down.

In one embodiment, the container 100 includes a cap 192 on a spout side of the container, as shown in FIG. 1. In such embodiment, cap 192 is a threaded plastic cap that can be removed so that the product can be poured out. In another embodiment that lacks a spout, the product is poured out by manipulating the gable top so as to open part of the gable top in a manner well known, thereby making a spout.

Figure 2:
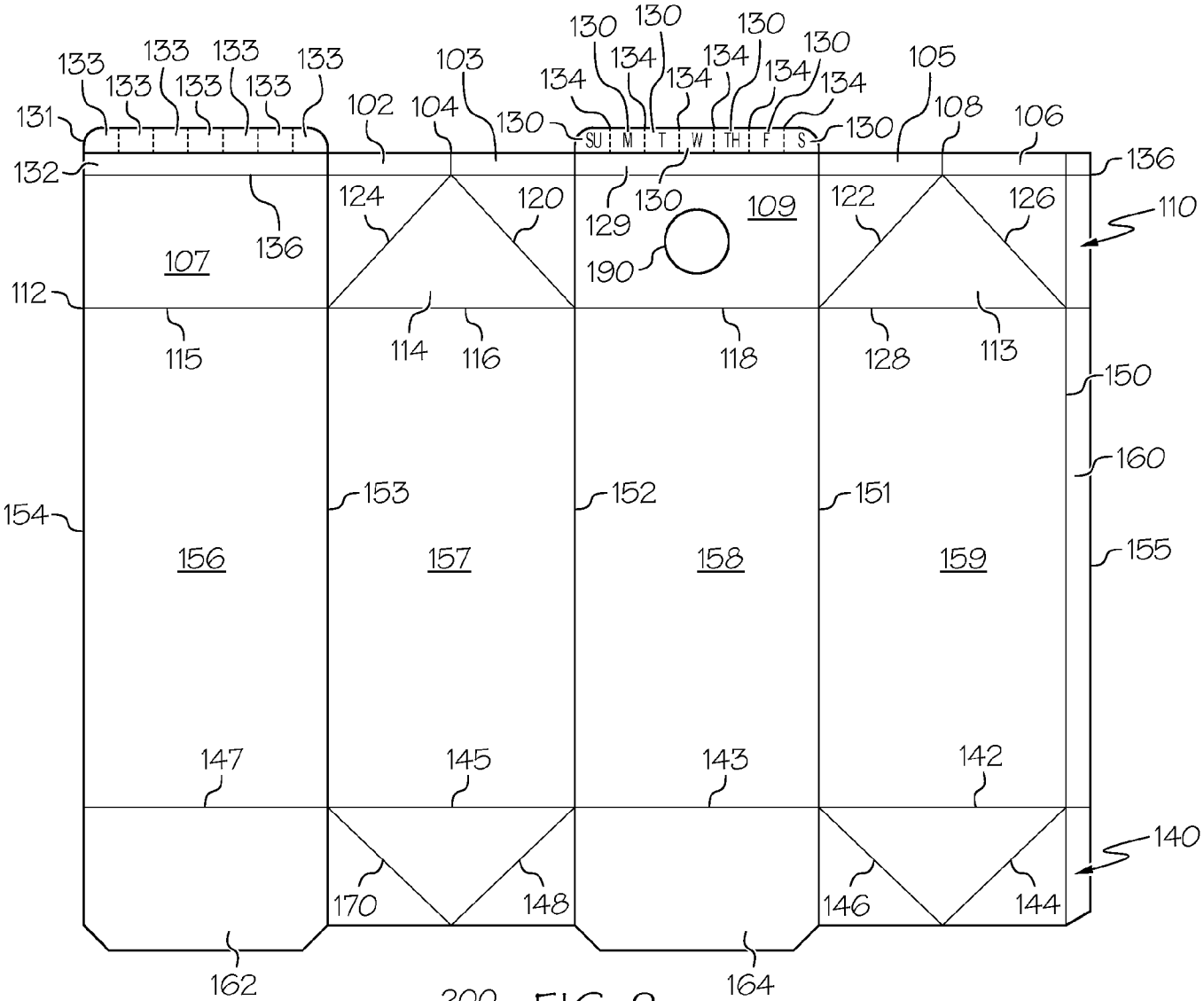
FIG. 2 is a plan view of one embodiment of a blank of the gable-top paperboard-style container of FIG. 1.

FIG. 2 is a plan view of one embodiment of a blank 200 of the gable-top paperboard-style container 100. In one embodiment, the blank 200 comprises paper covered with a substance, such as wax, thermoplastic resin or another material appropriate for such application, to make the paper nearly leak-proof or completely leak-proof, and, in some cases, also sterile. In other embodiments, the blank 200 is not made with paper but instead is made with other suitable materials such as plastic. The blank 200 is divided in conventional fashion by longitudinal crease, or fold, lines 150-153 into four main body panels 156-159. The blank 200 has a left edge 154, a right edge 155, and a flap 160 between fold line 150 and the right edge 155. An adhesive is applied at the flap 160 to maintain the blank 200 in a form of the container 100 after the blank is folded into the shape of the container. Lateral fold lines 115, 116, 118 and 128 separate the main body panels 156-159 from the top 110 of the blank 200. Of course, the top 110 of the blank 200 becomes the top of the container 100, after manufacture.

Still other lateral fold lines 142, 143, 145 and 147 separate the main body panels 156-159 from the bottom 140 of the blank 200. Angular fold lines 144, 146, 148 and 170 define flaps of the bottom 140. The bottom 140 includes exterior flaps 162 and 164. The other lateral fold lines 142, 143, 145 and 147 separate the main body panels 156-159 from the bottom 140 of the blank 200. Of course, the bottom 140 of the blank 200 becomes the bottom of the container 100, after manufacture. The bottom 140 includes exterior flaps 162 and 164.

The top 110 of the blank 200 includes portions of the blank that will form the gable top. The top 110 includes a rear top panel 107 and front top panel 109 directly above main body panels 156 and 158, respectively. Above main body panels 157 and 159 are triangular side panels 114 and 113, respectively, each triangular side panel having two subordinate end panels on either side thereof. Above the array of top panels there are corresponding sealing panels that are divided by lateral score lines into sealing panels 102, 103, 105, 106, 129 and 132. In one embodiment, the top panel 109 includes a hole 190. The top 110 of the blank 200 includes portion(s) of the blank that will form the day of opening reminder 131 in accordance with the invention. The top 110 includes tab portions 130 and tab portions 133. In FIG. 2, the day of week indicators are shown on the tab portions 130. Referring now to FIGS. 1 and 2, the tabs 163 of the day of opening reminder 131 are formed when the tab portions 130 and the tab portions 133 are brought together. The day of opening reminder 131 is made of a same material as the blank 200 and is an integral part of the blank.

Figure 3B:
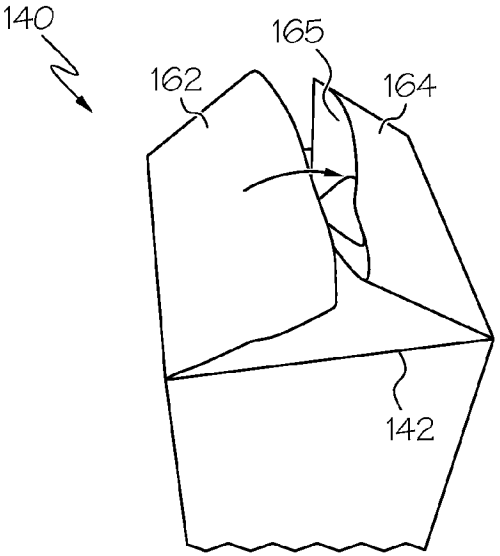
FIGS. 3A, 3B and 3C are perspective views of a bottom portion of the gable-top paperboard-style container of FIG. 1 at three successive stages of manufacture.
Figure 3A:
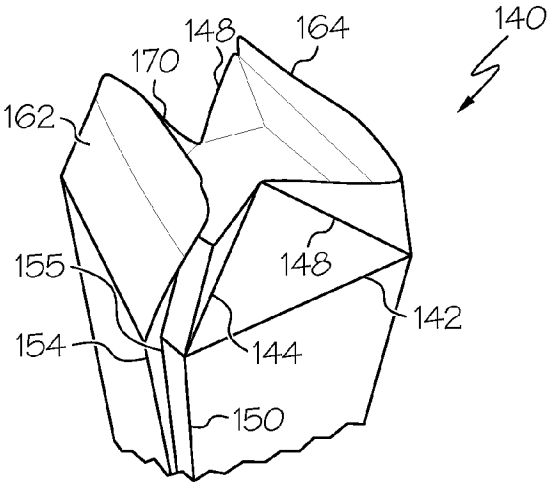
Figure 3C:
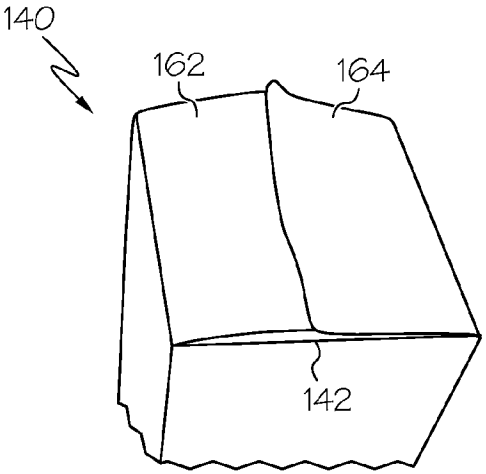

FIGS. 3A, 3B and 3C are perspective views of a bottom portion of the container 100, at three successive stages of manufacture, in a manner well known, starting with FIG. 3A and ending with FIG. 3C.

Figure 4B:
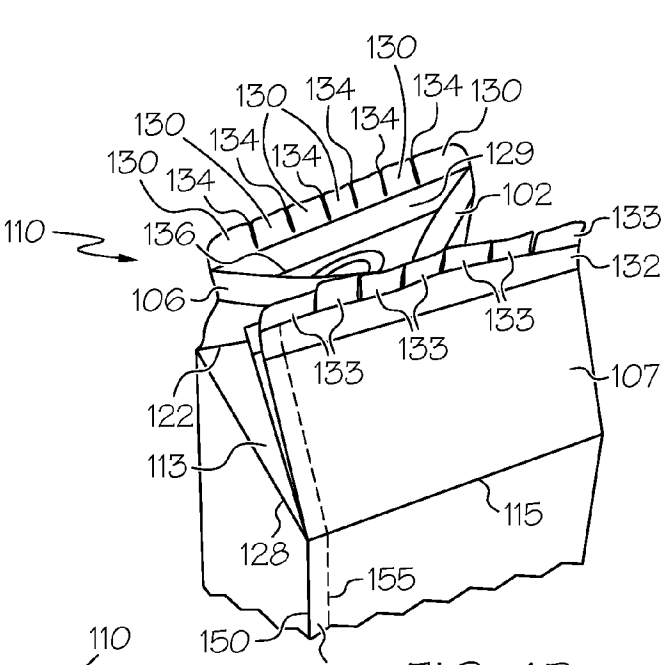
FIGS. 4A, 4B and 4C are perspective views of a top portion of the gable-top paperboard-style container of FIG. 1, at three successive stages of manufacture.
Figure 4A:
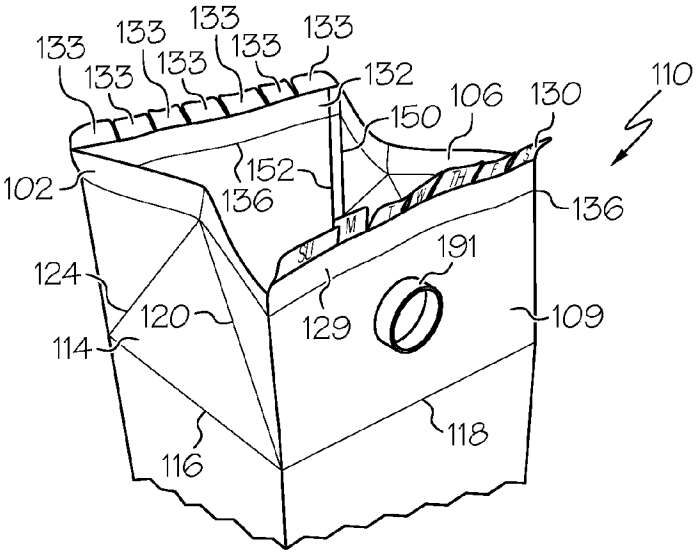
Figure 4C:
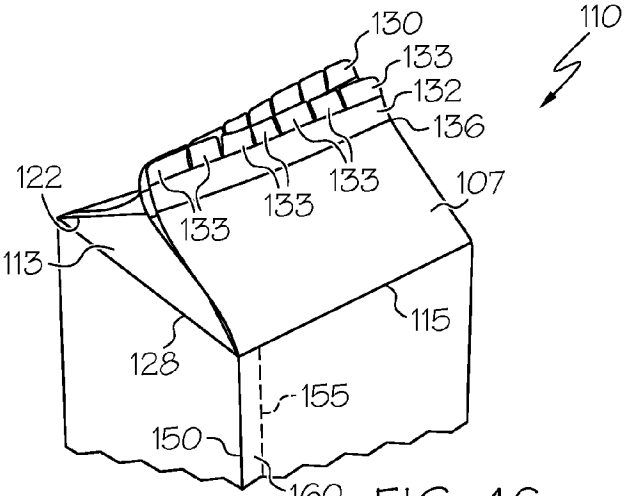

FIGS. 4A, 4B and 4C are perspective views of a top portion of the container 100, at three successive stages of manufacture, in a manner well known, starting with FIG. 4A and ending with FIG. 4C. After the container 100 is filled with product, the triangular side panels 113 and 114 are folded inward over the top of the container, bringing sealing panels 102, 103, 105, 106, 129 and 132 into contact with each other, and all of these upper sealing panels are adhered together to form a liquid-tight gable top closure for the filled container. When so adhered, sealing panels 102, 103, 105, 106, 129 and 132 surmount the top of the container and form a narrow ridge, extending from one end to the other end of the apex of the gable top. In one embodiment, the top panel 109 includes an element 191 that fits into hole 190, as shown in FIG. 4A. The element 191 is a threaded plastic element that accepts cap 192.

Each tab 163 of the day of opening reminder 131 includes a different marking, or symbol, that corresponds to a name of a day of the week. In one embodiment, such symbols are added to the tabs 163 of the day of opening reminder 131 when the container is in the form of the blank 200. In another embodiment, such symbols are added to the tabs 163 of the day of opening reminder 131 after the blank 200 is formed into the container 100. In still another embodiment, such symbols are added to the tabs 163 of the day of opening reminder 131 after container 100 is filled with product and sealed. In yet another embodiment, such symbols are added to the tabs 163 of the day of opening reminder 131 after container 100 is filled with product and sealed, and at a same time as the use-by date is added to the container.

Figure 5:
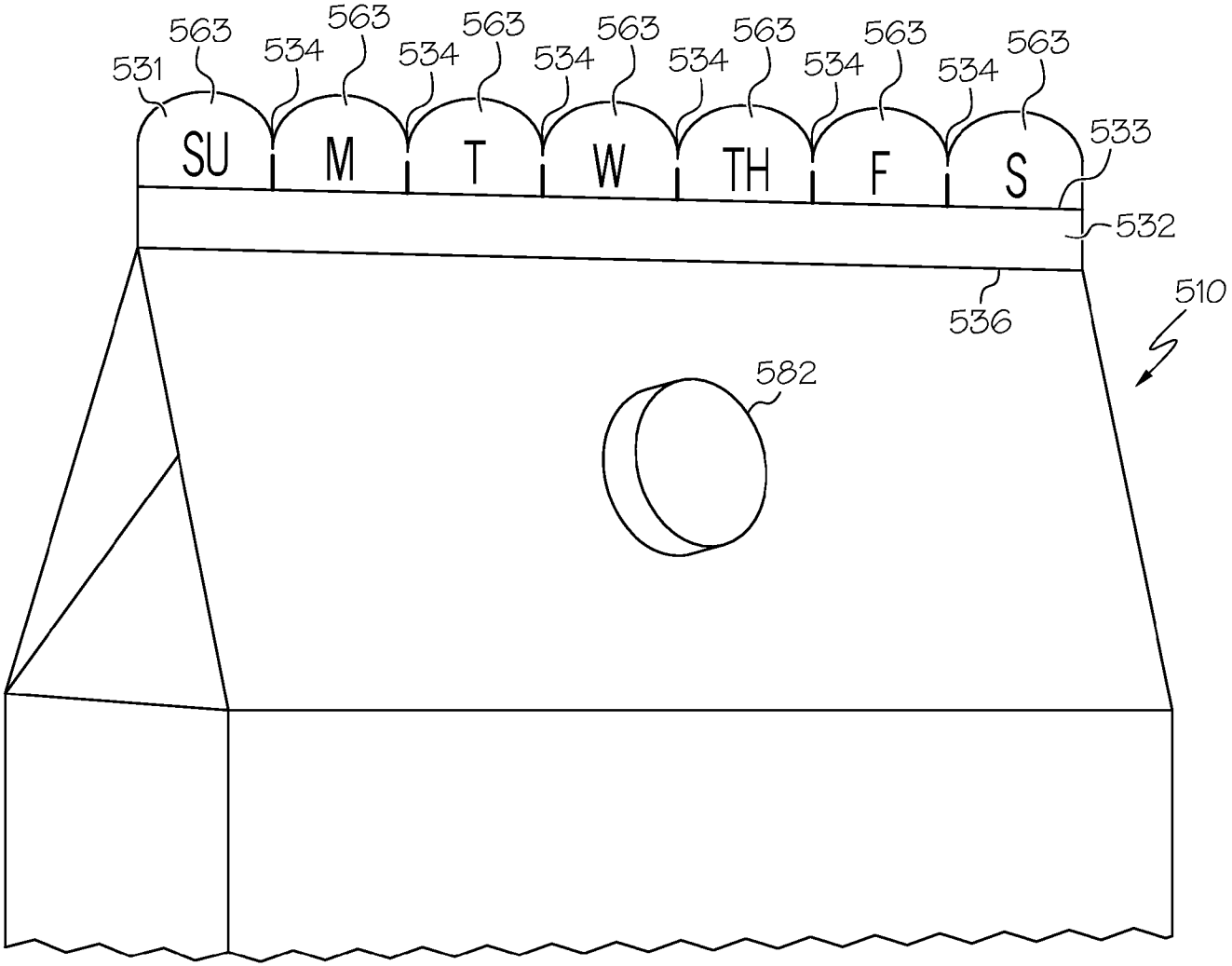
FIG. 5 is a perspective view of a top portion of another embodiment of a gable-top paperboard-style container in accordance with the invention.

FIG. 5 is a perspective view of a top portion 500 of a gable-top container in accordance with another embodiment of the invention. The top portion 500 includes a gable top 510, and a cap 582. A sealing panel exists above a lateral crease line 536. A day of opening reminder 531 exists above a lateral crease line 533. The day of opening reminder 531 includes a set of seven bendable tabs 563 with perforations 534, or alternatively cuts, between each tab. Each bendable tab 563 has a separately curved top edge to further distinguish each bendable tab and to facilitate selection of a single bendable tab. A selected bendable tab 563 is bendable along the lateral crease line 533. The selected bendable tab 563 is also bendable above the lateral crease line 533. The sealing panel 532 prevents the contents of the container from coming out in spite of a tab being bent down.

Although the embodiments shown in FIGS. 1-2 and 4-5 shown the abbreviations for the days of the week on a spout side of the container 100, in other embodiments (not shown), the abbreviations for the days of the week are on the side opposite the spout side, or are on both sides.

Figure 6:
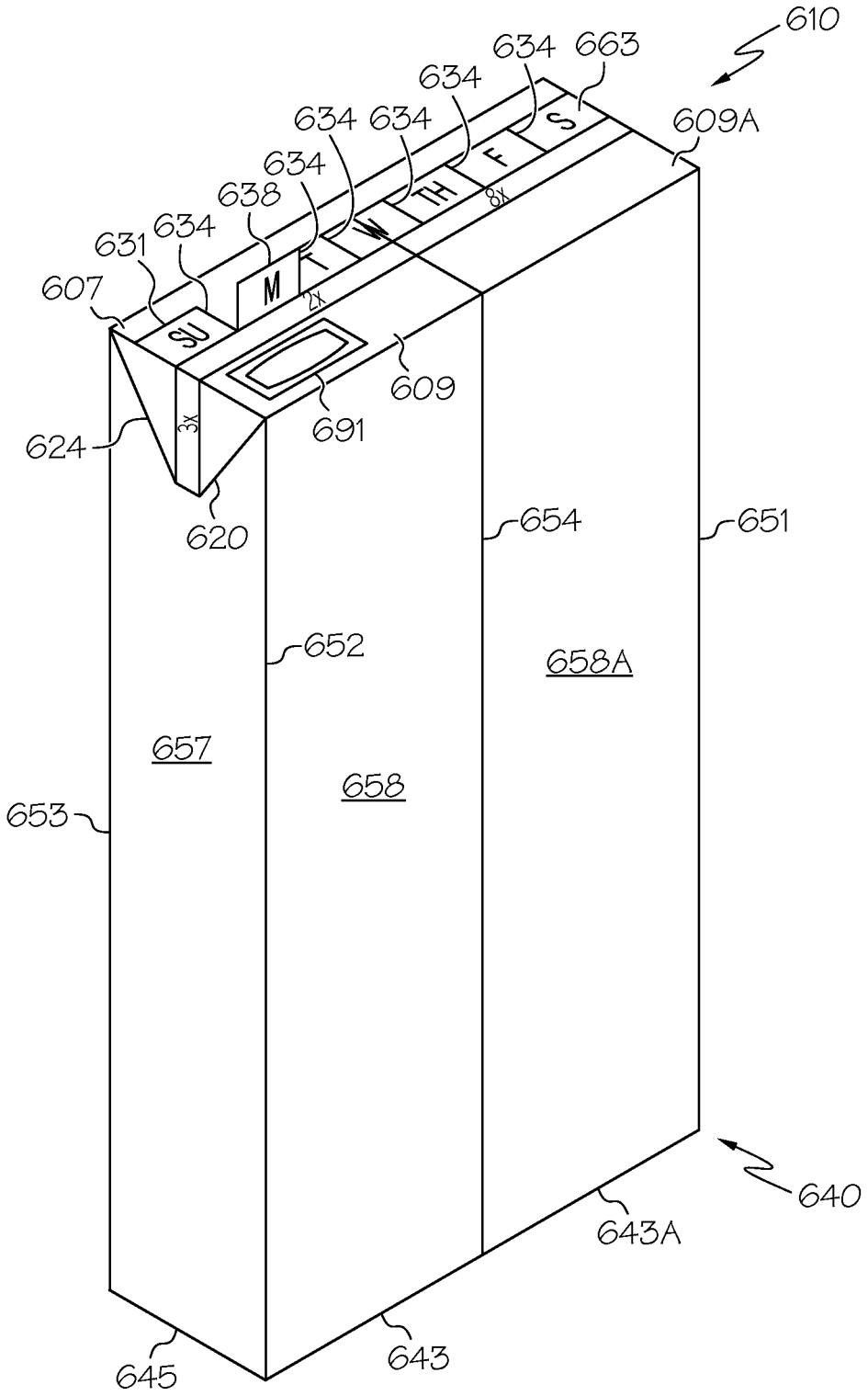
FIG. 6 is a perspective view of one embodiment of a flat-top paperboard-style container in accordance with the invention.

FIG. 6 is a perspective view of a flat-top paperboard-style container 600 (hereinafter "container 600") in accordance with one embodiment of the invention. The container 600 includes a body that a general shape of a parallelepiped. In one embodiment, the body has a general shape of a rectangular cuboid. FIG. 6 shows the container 600 with a flat top 610, a substantially flat bottom 640, and four flat sides (only three of the four flat sides, main body panels 657, 658 and 658A, appear in FIG. 6). The container 600 is a type of container that is widely used for packaging of edible liquids such as milk, dairy, dairy-substitutes, fruit juices, etc., that have a use-by date and do not need to be refrigerated until opened. The container 600 can also be used for packaging non-edible liquids and granular or pourable materials that have a use-by date. The container 600 is formed from a paperboard blank 700 (see FIG. 7). The container 600 has a sealed flat top at a top of the container that keeps the container sealed until the contents of the container are ready for use. The sealed flat top is created by sealing panels 1*x*, 2*x*, 3*x*, 4*x*, 5*x*, 6*x*, 7*x* and 8*x* at the top of the container 600. The flat top is provided with a day of opening reminder 631 in accordance with the invention. The day of opening reminder 631 includes a set of seven tabs 663 made of a same material as the container.

The day of opening reminder 631 includes lines of perforations 634, or alternatively cuts, between each tab. The lines of perforations 634, when selectively broken, allow any one of the seven tabs 663 to be moved into a different position relative to the other tabs, thereby conveying information about the day of week that the container 600 was first opened. Tab 638 is one tab among the plurality of tabs 663 which has been assigned a specific reference number for discussion purposes herein. Tab 638 is the second tab from the left in FIG. 6, and has an "M" on it. As shown in FIG. 6, tab 638 has been separated along the lines of perforations 634 or cuts between tab 638 and the tabs 663 on each side of tab 638. In FIG. 6, the second tab from the left, i.e., tab 638, is shown in a bent up position from its original position. Advantageously, a user is able to manually bend up the tab 638 without bending up any of the other tabs 663, and, in particular, without bending up the adjacent tabs 663. As shown in FIG. 6, the tab 663 with "SU" on it and the tab 663 with "T" on it remain in their original down positions. Advantageously, repositioning one tab (such as tab 638) relative to the other tabs 663 does not affect the seal of the container 600. The sealing panels 1*x*, 2*x*, 3*x*, 4*x*, 5*x*, 6*x*, 7*x* and 8*x* prevent the contents of the container 600 from coming out in spite of a tab, such as tab 638, being bent up.

In one embodiment, the container 600 includes a snap cap 691 on a spout side of the container, as shown in FIG. 6. The snap cap 691 is made of plastic or another suitable material. In such embodiment, the snap cap 691 can be opened and an internal safety seal removed so that the product can be poured out.

Figure 7:
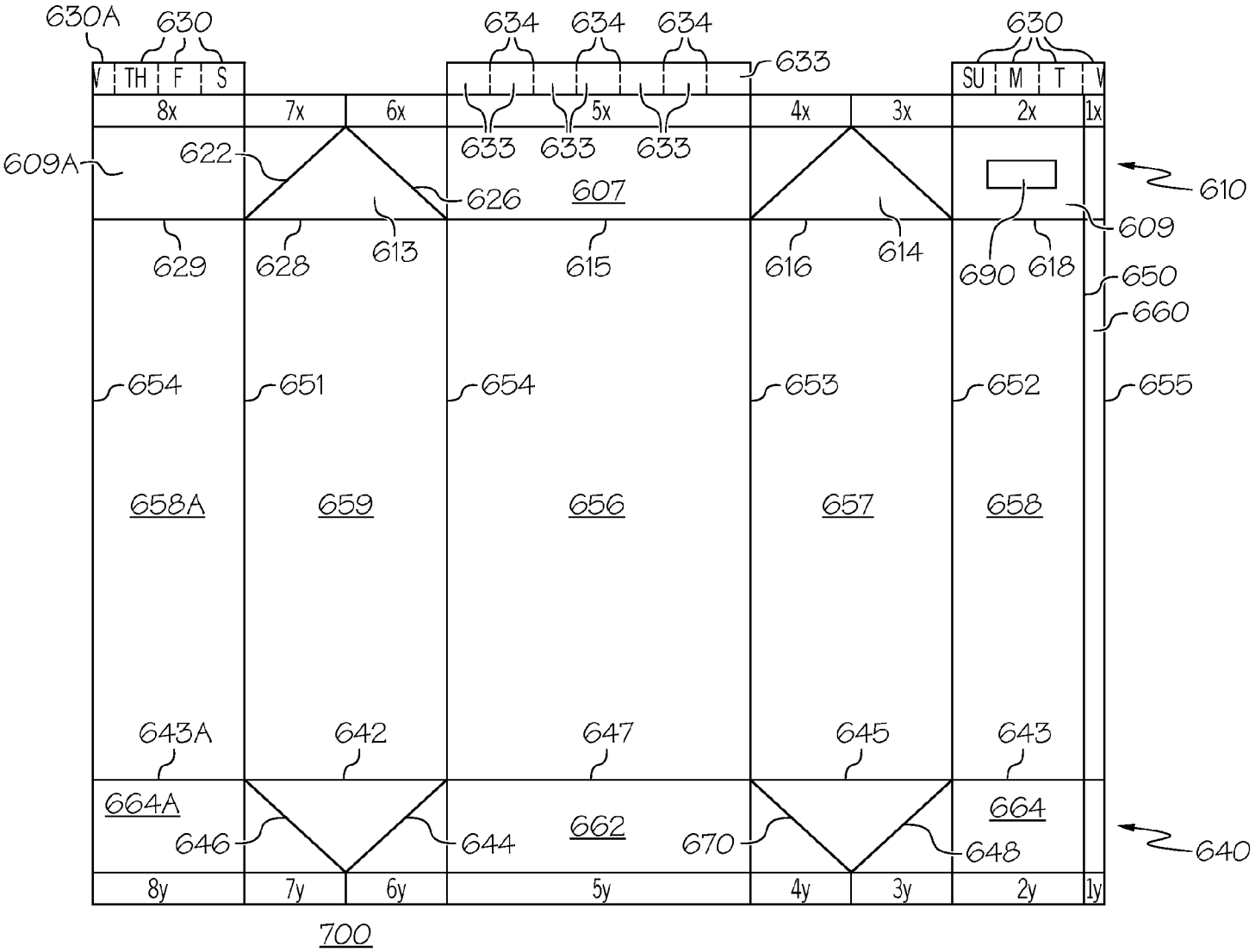
FIG. 7 is a plan view of one embodiment of a blank of the flat-top paperboard-style container of FIG. 6.

FIG. 7 is a plan view of one embodiment of a blank 700 of the container 600. In one embodiment, the blank 700 comprises paper covered with a substance, such as wax or thermoplastic resin, to make the paper nearly leak-proof or completely leak-proof, and, in some case, also sterile. In other embodiments, the blank 700 is not made with paper but instead is made with other suitable materials such as plastic. The blank 700 is divided in conventional fashion by longitudinal crease, or fold, lines 650-654 into five main body panels 656, 657, 658, 658A and 659. The blank 700 has a left edge 654, a right edge 655, and a flap 660 between seal line 650 and the right edge 655. An adhesive is applied at the flap 660 to maintain the blank 700 in a form of the container 600 after the blank is folded into the shape of the container. Lateral fold lines 615, 616, 618, 628 and 629 separate the main body panels 656, 657, 658, 658A and 659 from the top 610 of the blank 700. Of course, the top 710 of the blank 700 becomes the top of the container 600, after manufacture.

Still other lateral fold lines 642, 643, 643A, 645 and 647 separate the main body panels 656, 657, 658, 658A and 659 from the bottom 640 of the blank 700. Angular fold lines 644, 646, 648 and 670 define exterior flaps of the bottom 640. The bottom 640 includes exterior flaps 662, 664 and 664A. The other lateral fold lines 642, 643, 643A, 645 and 647 separate the main body panels 656, 657, 658, 658A and 659 from the bottom 640 of the blank 700. Of course, the bottom 640 of the blank 700 becomes the bottom of the container 600, after manufacture. The bottom 640 includes exterior flaps 662, 664 and 664A.

The top 610 of the blank 700 includes portions of the blank that will form the flat top. The top 610 includes a rear top panel 607 and front top panels 609 and 609A directly above main body panels 656 and 658 and 658A, respectively. Above the main body panels 657 and 659 are triangular side flaps 614 and 613, respectively, each triangular side flap folds down and glues onto the main body panels 657 and 659 having two subordinate end panels on either side thereof. Above the array of top panels there are corresponding sealing panels that are divided by lateral score lines into upper sealing panels 1*x*-8*x*. In one embodiment, the top panel 609 includes a hole 690. The top 610 of the blank 700 includes portion(s) of the blank that will form the day of opening reminder 631 in accordance with the invention. The top 610 includes tab portions 630 and tab portions 633. In FIG. 7, the day of week indicators are shown on the tab portions 630 and partly on tab portion 630A. Referring now to FIGS. 6 and 7, the tabs 663 of the day of opening reminder 631 are formed when the tab portions 630 and the tab portions 633 are brought together. In other words, a single tab 663 is formed when a single tab portion 630 and a corresponding single tab portion 633 are brought together. The day of opening reminder 631 is made of a same material as the blank 700 and is an integral part of the blank.

Figure 8B:
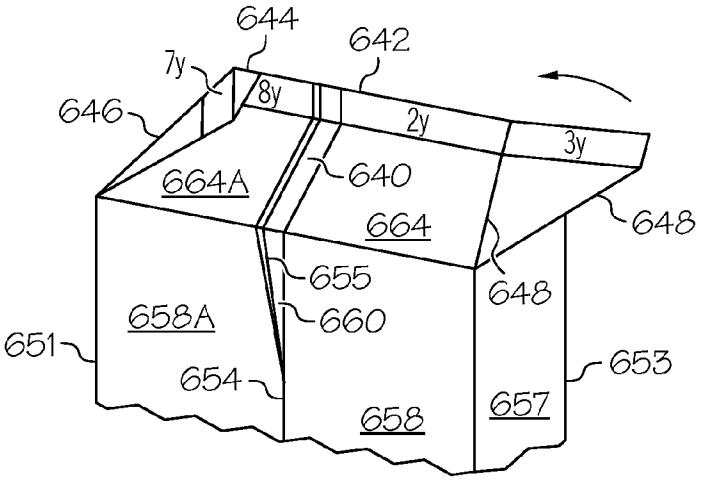
FIGS. 8A, 8B and 8C are perspective views of a bottom portion of the flat-top paperboard-style container of FIG. 6 at three successive stages of manufacture.
Figure 8A:
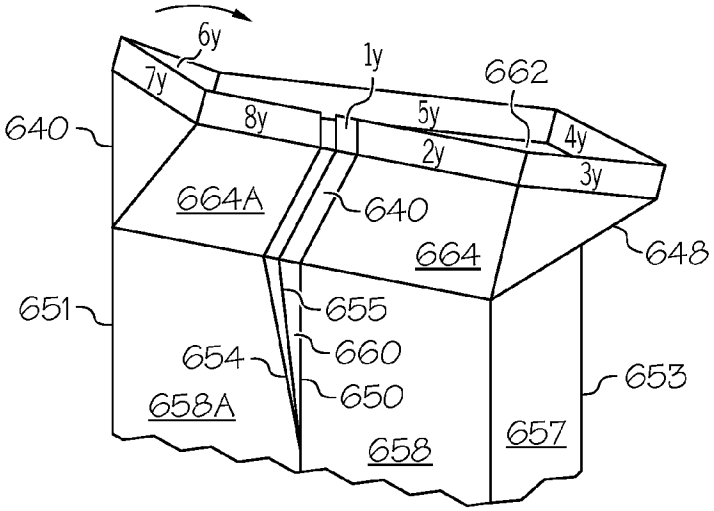
Figure 8C:
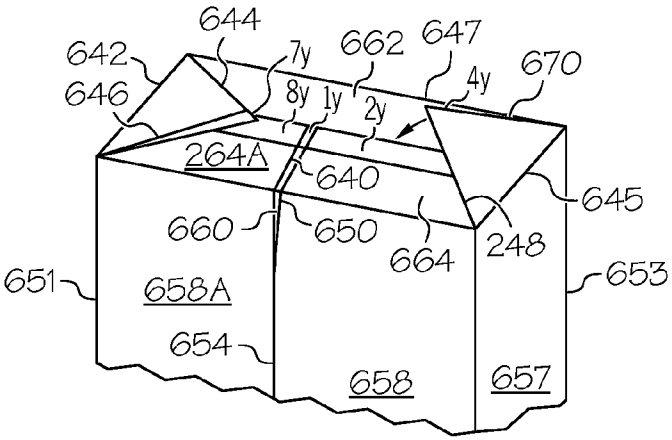

FIGS. 8A, 8B and 8C are perspective views of a bottom portion of the container 600, at three successive stages of manufacture, in a manner well known, starting with FIG. 8A and ending with FIG. 8C.

Figure 9B:
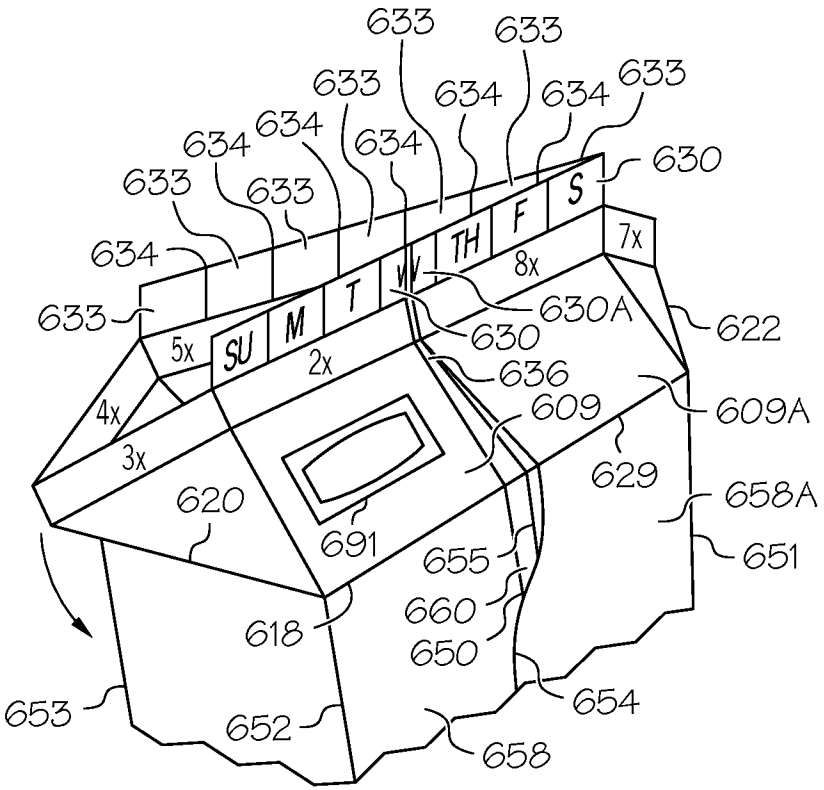
Figure 9A:
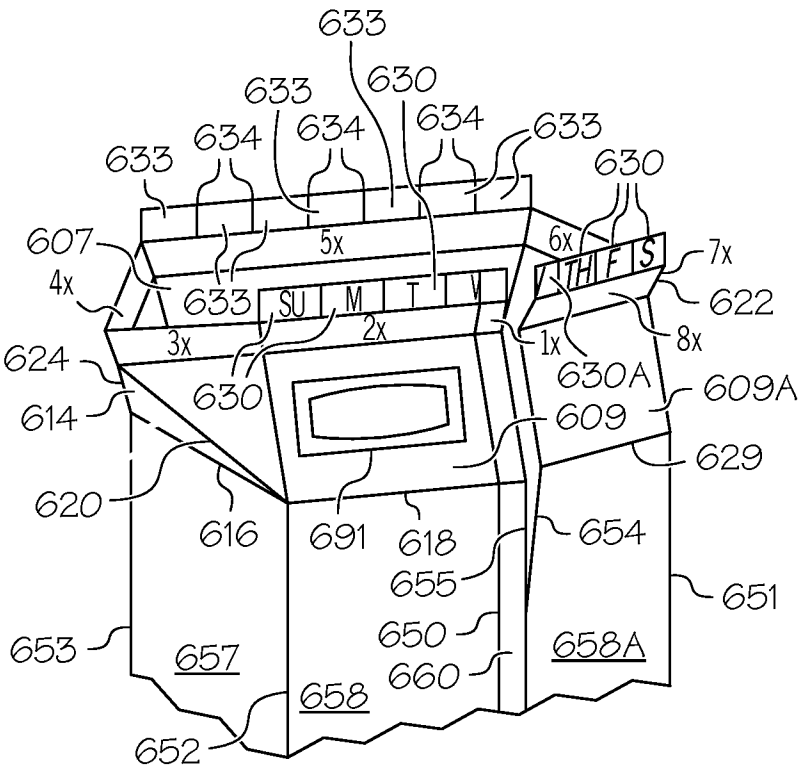

FIGS. 9A, 9B and 9C are perspective views of a top portion of the container 600, at three successive stages of manufacture, in a manner well known, starting with FIG. 9A and ending with FIG. 9C. After the container 600 is filled with product, the triangular side panels 613 and 614 are folded downward over the side main body panels 657 and 659 of the container, and sealing panels 1*x*-8*x* come into contact with each other, and all of these upper sealing panels are adhered together to form a liquid-tight top closure for the filled container. When so adhered, sealing panels 1*x*-8*x* surmount the top of the container and form a narrow ridge, extending from one end to the other end of the apex of the flat top. In one embodiment, the top panel 609 includes the snap cap 691 which fits into the hole 690, as shown in FIG. 9A.

Each tab 663 of the day of opening reminder 631 includes a different marking, or symbol, that corresponds to a name of a day of the week. In one embodiment, such symbols are added to the tabs 663 of the day of opening reminder 631 when the container is in the form of the blank 700. In another embodiment, such symbols are added to the tabs 663 of the day of opening reminder 631 after the blank 700 is formed into the container 600. In still another embodiment, such symbols are added to the tabs 663 of the day of opening reminder 631 after container 600 is filled with product and sealed. In yet another embodiment, such symbols are added to the tabs 663 of the day of opening reminder 631 after container 600 is filled with product and sealed, and at a same time as the use-by date is added to the container.

In another embodiment (not shown), there are no perforations 134, 634 between the tabs 163, 663. In such other embodiment, the day of opening reminder 131, 631 includes other means to facilitate manual separation of a selected tab, such as tab 138, 638, from the other tabs 163, 663.

In yet another embodiment (not shown), there are no perforations 134, 634 between the tabs 163, 663, and the day of opening reminder 131, 631 does not include any means to facilitate manual separation of a selected tab (such as tab 138, 638) from the other tabs 163, 663. In such embodiment, reasonable manual force can nevertheless be used to separate a selected tab from the other tabs 163, 663.

In still other embodiments, the tabs are completely separated from each other at the time of manufacture, such as by cuts in the paperboard-like material between each tab. In one such embodiment, all seven tabs 163 remain upright until a user manually folds down, removes, or otherwise alters a selected tab. In another such embodiment, all seven tabs 663 remain down and flat against the top 610 of the container 600 until a user manually folds up, removes, or otherwise alters a selected tab.

In another embodiment (not shown), the tab material is not an integral part of the blank material, but is added to the container.

In another embodiment (not shown), a material of the tab is not a same material as a material of the blank, but is of a different material as the material of the blank. In such other embodiment, the container includes a sticker-type strip that includes the day of opening reminder 131, 631. In such other embodiment, the sticker-type strip is made of a material different from the material of the blank 200, 700. In such other embodiment, the sticker-type strip is attached to the material of the blank 200, 700 (and, consequently, is attached to the container 100, 600).

In another embodiment (not shown), the tabs are formed after the blank is folded into a container.

In another embodiment (not shown), the tabs are formed after the container is filled with product and sealed.

In another embodiment (not shown), each tab has a line of perforations defining a perimeter within the tab to facilitate the punching out of, or otherwise removing, the area of the tab within the perimeter, by a user to indicate the day that the container was first opened.

In another embodiment (not shown), the day of opening reminder includes means for completely removing a selected tab from the container. In such other embodiment, the means may include additional perforations at the bottom of each tab.

In another embodiment (not shown), the container has fewer than seven tabs.

In another embodiment (not shown), the container has more than seven tabs. In one such embodiment, the container has eight (8) tabs including seven (7) daily tabs and one (1) additional tab, such that the condition, or position, of the additional tab indicates that the container has been open for more than one week (in other words, was opened more than one week ago).

The terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles.

Unless stated otherwise, terms such as "first" and "second" are used to arbitrarily distinguish between the elements such terms describe. Thus, these terms are not necessarily intended to indicate temporal or other prioritization of such elements.

The specification and figures are to be regarded in an illustrative rather than a restrictive sense, and all such modifications are intended to be included within the scope of the present invention. Any benefits, advantages or solutions to problems described herein with regard to specific embodiments are not intended to be construed as a critical, required or essential feature or element of any or all the claims.

The Detailed Description section, and not the Abstract section, is intended to be used to interpret the claims. The Abstract section may set forth one or more but not all embodiments of the invention, and the Abstract section is not intended to limit the invention or the claims in any way.

Although the invention is described herein with reference to specific embodiments, various modifications and changes can be made without departing from the scope of the present invention as set forth in the claims below.

What is claimed is:

1. A gable-top container for holding a pourable product, comprising:

a piece of material with a plurality of cutouts, fold lines and perforations for forming a sealable container when folded to include a rectangular body, a substantially flat bottom, and a substantially gable top having a top edge, the substantially gable top including a series of bendable tabs disposed at the top edge and lines of perforations in the material, each line of perforations defining a boundary between adjacent bendable tabs, wherein the bendable tabs are directly adjacent to each other and are only separated by a line of perforations, wherein the gable-top container remains sealed after one, some or all of the bendable tabs are bent.

2. The gable-top container of claim 1, wherein the series of bendable tabs includes at least seven bendable tabs.

3. The gable-top container of claim 2, wherein each of the at least seven bendable tabs includes a marking on the bendable tab denoting a day of a week selected from a group of days of a week, Sunday, Monday, Tuesday, Wednesday, Thursday, Friday and Saturday.

4. The gable-top container of claim 3, wherein the marking is an abbreviation for a day of the week.

5. The gable-top container of claim 1, wherein the piece of material is paperboard material.

6. The gable-top container of claim 1, wherein the material is a plastic material.

7. The gable-top container of claim 1, further including a circular spout with a removable cap formed in the gable top.

8. A blank for forming the gable-top container described in claim 1.

9. A container for holding a pourable product, comprising:

a piece of material with a plurality of cutouts, fold lines and perforations for forming a sealable container when folded to include a body, a substantially flat bottom, a top including a top sealing panel, and a plurality of bendable tabs disposed entirely above the top sealing panel, wherein the bendable tabs are directly adjacent to each other and are only separated by a line of perforations, wherein the container remains sealed after one, some or all of the bendable tabs are bent.

10. The container of claim 9, wherein the plurality of bendable tabs includes seven bendable tabs, and wherein each of the seven bendable tabs includes a marking on the bendable tab denoting a day of a week selected from a group of days of a week, Sunday, Monday, Tuesday, Wednesday, Thursday, Friday and Saturday.

11. The container of claim 9, wherein the material is paperboard.

12. The container of claim 9, further including a spout formed at a top of the container.

13. A blank for forming the container described in claim 9.

14. A container for holding a pourable product, comprising:

a piece of material with a plurality of cutouts, fold lines and perforations for forming a sealable container when folded to include a body, a bottom, a top including a top sealing panel, and a plurality of tabs disposed above the top sealing panel, wherein the tabs are directly adjacent to each other and are only separated by perforations, wherein the container remains sealed after one, some or all of the tabs are bent or removed.

15. The container of claim 14, wherein the plurality of tabs includes at least seven tabs.

16. The container of claim 15, wherein each of the seven tabs includes a marking denoting a day of a week selected from a group of days of a week, Sunday, Monday, Tuesday, Wednesday, Thursday, Friday and Saturday.

17. The container of claim 14, wherein the material is paperboard.

18. The container of claim 14, wherein the material is a plastic material.

19. The container of claim 14, further including a spout with an adjoined snap cap formed in the flat top.

20. A blank for forming the container described in claim 14.

* * * * *